United States Patent [19]

Naka et al.

[11] Patent Number: 4,592,759

[45] Date of Patent: Jun. 3, 1986

[54] PRODUCTION OF AQUEOUS COAL SLURRIES HAVING HIGH COAL CONTENTS

[75] Inventors: Akihiro Naka, Joyo; Tominobu Mayuzumi; Hiroshi Sugiyama, both of Kyoto, all of Japan

[73] Assignee: Dai-Ichi Kogyo Seiyaku Co., Ltd., Kyoto, Japan

[21] Appl. No.: 581,455

[22] Filed: Feb. 17, 1984

[30] Foreign Application Priority Data

| | | | |
|---|---|---|---|
| Feb. 25, 1983 | [JP] | Japan | 58-31535 |
| Mar. 1, 1983 | [JP] | Japan | 58-34279 |
| Mar. 2, 1983 | [JP] | Japan | 58-35114 |

[51] Int. Cl.[4] ..... C10L 1/32

[52] U.S. Cl. ..... 44/51; 44/73; 44/77; 252/351; 252/357

[58] Field of Search ..... 44/51, 72, 77, 71, 73, 44/75; 252/351, 352, 356, 357

[56] References Cited

U.S. PATENT DOCUMENTS

| | | | |
|---|---|---|---|
| 4,251,229 | 2/1981 | Naka et al. | 44/51 |
| 4,282,006 | 8/1981 | Funk | 44/51 |
| 4,358,293 | 11/1982 | Mark | 44/51 |
| 4,389,219 | 6/1983 | Naka et al. | 44/51 |
| 4,436,527 | 3/1984 | Yamamura et al. | 44/51 |

FOREIGN PATENT DOCUMENTS

| | | | |
|---|---|---|---|
| 56-136665 | 10/1981 | Japan . | |
| 57-155294 | 9/1982 | Japan | 44/51 |

*Primary Examiner*—William R. Dixon, Jr.
*Assistant Examiner*—Margaret B. Medley
*Attorney, Agent, or Firm*—Millen and White

[57] ABSTRACT

Coarse coal particles are pulverized to at least 70% passing through a standard 200 mesh screen in the presence of water in an amount to form aqueous coal slurries having a coal concentration from 60 to 80% by weight. The pulverization is carried out also in the presence of polyether typed polyoxyalkylene adducts having a high molecular weight with polyols having at least three active hydrogen atoms, phenol/aldehyde condensates of polyalkyleneimines, or derivatives of these adducts.

10 Claims, No Drawings

PRODUCTION OF AQUEOUS COAL SLURRIES HAVING HIGH COAL CONTENTS

BACKGROUND OF THE INVENTION

This invention relates to a method for forming aqueous coal slurries having high coal contents by directly pulverizing coarse coal particles in the presence of water.

The use of coal as an energy source has now become important for substituting for petroleum and a number of techniques for utilizing coal are being studied. One such technique is directed to aqueous slurries of pulverized coal which may be transported and burnt as such.

Generally, coal may be disintegrated either by dry process or by wet process. However, the dry process has difficulties such as risks of explosion, environmental problems caused by coal dust, low operational efficiency etc., particularly when coal is to be pulverized as fine as possible.

The wet process is more advantageous than the dry process in that not only it does not have the above difficulties but also it may dispense with a separate step of dispersing pulverized coal in water to form aqueous coal slurries.

For use as a fuel aqueous coal slurries must have high coal concentrations and the coal particles therein must be very fine. When coarse coal particles are successively divided into finer particles by the wet process, fresh surfaces having high surface energy levels are constantly exposed without being wetted well with water and thus the resulting particles tend to agglomerate by the action of interparticle cohesive forces. This greatly decreases the pulverization efficiency and requires more power consumption to continue further pulverization. These phenomena become more striking with increasing coal concentrations and descreasing particle size in the aqueous coal slurry. When agglomeration takes place the slurry loses its fluidity so that its further pulverization and discharge impossible.

Japanese Unexamined Patent Publication No. 136,665/1981 discloses an additive to be used in conjunction with the wet pulverization of coal to avoid the above-mentioned difficulties. However, this agent has been proven in practice to be effective only at coal concentrations less than 60% by weight. At coal concentrations higher than 60% the resulting slurry loses its fluidity before coal particles reach 70% passing through a 200 mesh screen.

It is an object of the present invention to provide a process for forming aqueous slurries of finely divided coal particles by directly pulverizing coarse coal blocks or particles in the presence of water with the aid of an agent which facilitates the wet pulverization of coal.

DESCRIPTION OF THE INVENTION

According to the present invention, there is provided a method for forming aqueous coal slurries which comprises pulverizing coarse coal particles in the presence of an amount of water sufficient to form said slurries having a coal concentration from 60 to 80% by weight until the coal particles are pulverized to at least 70% passing through a standard 200 mesh screen. The improvement resides in the addition of a polyether compound to the starting coal aqueous mixture to prevent freshly formed fine particles from agglomerating.

According to the present invention, said polyether compound is characterized by having a molecular weight from 16,000 to 300,000 and being (a) a polyoxyalkylene adduct with a polyhydroxyl compound having at least three active hydrogen atoms, (b) a polyoxyalkylene adduct with a condensate of a phenolic compound with an aliphatic aldehyde or (c) a polyoxyalkylene adducts with a polyalkyleneimine or (d) a derivative thereof containing 7 to 200 nitrogen atoms. Derivatives of these adducts formed by reacting their terminal hydroxyl groups with various reactants such as inorganic or organic esterifying agents, halogenating agents or monoisocyanates may also be used.

The above polyether compounds may be prepared by well-known methods, i.e. by reacting an appropriate starting active hydrogen compound with an alkylene oxide in the presence of an acid or alkaline catalyst.

Examples of starting polyhydroxyl compounds having three or more active hydrogen atoms include glycerine, butanetriol, hexanetriol, trimethylolpropane, triethanolamine, diglycerine, pentaerythritol, sorbitane, sorbitol, xylitol, glucose, sucrose, patially saponified poly(vinyl acetate), cellulose, starch and the like. Partially esterified polyols having three or more remaining hydroxyl groups may also be used.

Phenol-aldehyde condensate-type starting compounds are well-known. Examples of phenolic compounds include phenol, cresol, xylenol, butylphenol, nonylphenol, aminophenol, hydroxybenzoic acid, catechol, resorcine, pyrogallol, naphthol, methylnaphthol, butylnaphthol, octylnaphthol, naphthoresorcine, α-naphthohydroquinone, bisphenol A, bisphenol S and the like. Examples of aliphatic aldehydes include formaldehyde, acetaldehyde, glyoxal and the like. Formaldehyde is preferable. The degree of condensation generally ranges from 1.5 to 50, preferably between 2.0 to 30.

Examples of starting polyalkyleneimines includes polyethyleneimine, polypropyleneimine, addition products of ethyleneimine or propylene imine with alcohols, phenols, amines or carboxylic acids, amonolysis or aminolysis products of dihaloalkanes and the like. Also included in this class are derivatives of the above polyalkyleneimines derived by reacting these polyalkyleneimines with aldehydes, ketones, alkyl halides, isocyanates, thioisocyanates, active double bond-containing compounds, epoxy compounds, epihalohydrines, cyanamides, guanidines, urea, carboxylic acids, carboxylic acid anhydrides, acyl halides and the like. The polyalkylene imines and their derivatives must have from 7 to 200, preferably from 9 to 100 nitrogen atoms per molecule.

Examples of derivatives of polyoxyalkylene adducts formed by reacting their terminal hydroxyl groups with various reactants include esters with inorganic or organic acids, halides such as chloride or bromide (with hydrohalides or phosphorus halides), aldehydes or carboxylic acids (with oxydizing agents), urethanes (with monoisocyanates) and the like.

Examples of alkylene oxides include ethylene oxide, propylene oxide, butylene oxide and the like. More than one alkylene oxide may be addition-reacted with the starting active hydrogen compound to form a block or random copolymer. Preferably the polyether compound contains greater than 60% more preferably greater than 80% by weight of oxyethylene units, based on the total oxyalkylene content.

The polyether compounds used in the present invention are capable of being adsorbed by freshly formed coal surfaces and preventing the agglomeration of freshly formed coal particles. They are stable under strong impact and energy exerted on the coal particles during the pulverization process.

Although the present invention is not bound in any particular theory, it is postulated that the polyether compound used herein is strongly adsorbed by freshly formed coal particles and then hydrated with surrounding water molecules to prevent coal particles from agglomerating. This greatly facilitates to pulverize coal into fine particles even at high coal contents and maintains the resulting aqueous coal slurry to be flowable.

The types of coal which can be used herein include anthracite, bituminous and sub-bituminous. Anthracite and bituminous are preferable. It is preferred that raw coal blocks are crushed to coarse particles, e.g. about 2 mm size by the dry process before pulvering in a wet mill.

Any conventional wet mill such as ball mills or rod mills may be employed for pulverizing coarse coal particles to form aqueous coal slurries in accordance with the method of this invention. The mill is charged with coarse coal particles, water and the polyether compound simultaneously. The proportions of coal and water are such that the coal content in the final slurry ranges from 60 to 80% by weight. The proportion of the polyether compound ranges at least 0.03% by weight of the final slurry. The upper limit is a matter of economy and preferably less than 2.0% by weight of the final slurry. These materials are introduced to the mill either in one time or in portions. Preferably an amount of coal corresponding to a coal content of at least 40%, preferably 50 to 60% by weight of the final slurry is present in the first stage when coal is charged portionwise.

The mill should also be filled with grinding media such as balls or rods to occupy 15 to 55%, preferably 20 to 40% of its interior volume with the grinding media.

The wet pulverization should be continued until the coal is pulverized to at least 70% passing through a standard 200 mesh screen. Preferably the degree of pulverization does not exceed 90% passing through the 200 mesh screen. The wet pulverization may be performed in a batch operation or in the continuous mode.

In contradistinction, aqueous coal slurries having the desired characteristics cannot be obtained by directly pulverizing coal by the wet process if the polyether compound used herein is not present.

The following examples will further illustrate the invention. All parts and percents are by weight unless otherwise indicated.

EXAMPLE 1

Using various polyether compounds listed in Table I, aqueous coal slurries as shown in Table II were prepared from bituminous (china) or anthracite (Vietnam) of about 2 mm diameter size by one of the following Methods A, B and C.

METHOD A

Whole amounts of coal, water and polyether compound were introduced into a ball mill in one time and the coal was pulverized in one stage for 70 minutes.

METHOD B

In the first stage a portion of coal was pulverized in a ball mill charged with whole amounts of water and polyether compound for 40 minutes. Then the remaining coal was introduced and pulverized in the second stage for 30 minutes.

METHOD C

Method B was followed except that the ball mill was replaced by a rod mill.

After forming, the resultant slurry was withdrawn from the mill, and tested on its fluidity, viscosity, fineness and stability. The viscosity was measured with a B-type viscometer at 25° C. The fineness was measured in terms of percents of coal particles passing through a standard 200 mesh screen. The stability was measured by the following rod penetrating test. Namely, the slurry was poured into a measuring cylinder of 5.5 cm inner diameter X20 cm height up to 18 cm level and allowed to stand for 30 days. Then a lid having a center opening was placed on the top of the cylinder and a 5 mm diameter stainless steel rod weighting 50 g and having a flat end surface was inserted into the cylinder through the center opening. The length of time required for penetrating the slurry from the top level to the bottom with the flat surface of the rod by its own weight was determined. This length of time is inversely proportional to the stability due to the settlement of coal particles.

TABLE I

List of Polyether Compounds

| Compound No. | Starting Compound | Alkylene Oxide (%) | M.W. |
|---|---|---|---|
| 1 | glycerine | PO35, EO65 | 18,000 |
| 2 | triethanolamine | PO27, EO73 | 23,000 |
| 3 | diglycerine | PO15, BO3, EO82 | 80,000 |
| 4 | sorbitane | PO17, EO83 | 65,000 |
| 5 | sorbitol | PO15, EO85 | 30,000 |
| 6 | glucose | EO100 | 40,000 |
| 7 | dipentaerythritol | PO6, EO94 | 100,000 |
| 8 | starch | PO10, EO90 | 230,000 |
| 9 | tallow alcohol | PO50, EO50 | 3,000 |
| 10 | glycerine | PO40, EO60 | 5,000 |
| 11 | phenol/formaldehyde condensate (condensation degree 1.6) | PO37, EO63 | 25,000 |
| 12 | naphthol/formaldehyde condensate (condensation degree 1.8) | PO30, EO70 | 43,000 |
| 13 | butylphenol/formaldehyde condensate (condensation degree 3.0) | PO17, EO83 | 100,000 |
| 14 | methylnaphthol/formaldehyde condensate (condensation degree 3.0) | EO100 | 80,000 |
| 15 | nonphenol/formaldehyde condensate (condensation degree 8.0) | PO10, EO90 | 65,000 |
| 16 | cresol/formaldehyde condensate | PO5, BO3, EO92 | 50,000 |

TABLE I-continued

List of Polyether Compounds

| Compound No. | Starting Compound | Alkylene Oxide (%) | M.W. |
|---|---|---|---|
| | (condensation degree 5.0) | | |
| 17 | phenol/formaldehyde condensate (condensation degree 2.5) | EO100 | 70,000 |
| 18 | aminophenol/formaldehyde condensate (condensation degree 9.5) | PO12, EO88 | 240,000 |
| 19 | octylphenol/formaldehyde condensate (condensation degree 6.5) | PO5, EO95 | 120,000 |
| 20 | phosphate of No. 14, Na salt | — | — |
| 21 | sulfate of No. 15, $NH_4$ salt | — | — |
| 22 | sulfate of No. 19, diethanolamine salt | — | — |
| 23 | phenol/formaldehyde condensate (condensation degree 7.0) | EO100 | 5,000 |
| 24 | nonphenol/formaldehyde condensate (condensation degree 4.0) | PO20, EO80 | 10,000 |
| 25 | polyethyleneimine (N 7) | PO32, EO68 | 20,000 |
| 26 | polyethyleneimine (N 120) | PO30, EO70 | 26,000 |
| 27 | polyethyleneimine (N 180) | PO35, EO65 | 85,000 |
| 28 | polyethyleneimine (N 20) | PO10, BO5, EO85 | 65,000 |
| 29 | polyethyleneimine (N 25) | PO13, EO87 | 40,000 |
| 30 | polyethyleneimine (N 80) | PO18, EO82 | 120,000 |
| 31 | polyethyleneimine (N 55) | EO100 | 80,000 |
| 32 | polyethyleneimine (N 60) | EO100 | 55,000 |
| 33 | polyethyleneimine (N 90) | PO15, EO85 | 70,000 |
| 34 | polyethyleneimine (N 37) | PO5, EO95 | 260,000 |
| 35 | ethylene glycol/ethyleneimine adduct (N 45) | PO10, EO90 | 100,000 |
| 36 | butyphenol/ethyleneimine adduct (N 30) | PO7, EO93 | 60,000 |
| 37 | phosphate of No. 31, Na salt | — | — |
| 38 | sulfate of No. 33, $NH_4$ salt | — | — |
| 39 | laurylamine | PO60, EO40 | 3,000 |
| 40 | benzylamine | PO50, EO50 | 5,000 |

PO: propylene oxide, EO: ethylene oxide, BO: butylene oxide
Compound Nos. 9, 10, 23, 24, 39 and 40 are controls.

TABLE II

Aqueous Coal Slurries

| | Operation Conditions | | | | | | Characteristics | | | |
|---|---|---|---|---|---|---|---|---|---|---|
| Run No. | Coal | Method | % occupied by grinding media[1] | Polyether cpd., %[2] | Coal concentration, % 1st stage | Coal concentration, % Final stage | % passing through 200 mesh screen | Viscosity, cps | Fluidity | Stability, sec. |
| 1 | bituminous | A | 30 | No. 1, 0.7 | — | 66.0 | 72.0 | 2300 | Good | 5.0 |
| 2 | " | " | 23 | No. 5, 0.5 | — | 66.0 | 81.5 | 550 | " | 6.0 |
| 3 | " | " | 35 | No. 3, 0.5 | — | 68.5 | 74.0 | 1800 | " | 3.0 |
| 4 | " | B | 35 | No. 5, 0.5 | 53 | 71.0 | 82.0 | 1200 | " | 4.0 |
| 5 | " | " | 30 | No. 6, 0.5 | 59 | 71.0 | 85.5 | 1300 | " | 3.0 |
| 6 | " | C | 30 | No. 7, 0.5 | 55 | 71.0 | 79.0 | 1400 | " | 4.5 |
| 7 | " | " | 35 | No. 8, 0.5 | 59 | 71.0 | 77.5 | 1100 | " | 5.5 |
| 8 | anthracite | A | 35 | No. 2, 0.8 | — | 68.0 | 71.5 | 2400 | " | 8.0 |
| 9 | " | " | 35 | No. 5, 0.6 | — | 68.0 | 83.0 | 450 | " | 4.0 |
| 10 | " | " | 25 | No. 4, 0.6 | — | 72.0 | 75.5 | 1400 | " | 5.0 |
| 11 | " | B | 38 | No. 6, 0.6 | 52 | 75.0 | 86.0 | 1500 | " | 7.5 |
| 12 | " | " | 38 | No. 7, 0.6 | 58 | 78.0 | 82.5 | 1800 | " | 5.0 |
| 13 | " | C | 30 | No. 8, 0.6 | 52 | 75.0 | 81.0 | 1300 | " | 3.0 |
| 14 | " | " | 30 | No. 7, 0.6 | 58 | 78.0 | 78.0 | 1700 | " | 9.5 |
| 15 | bituminous | A | 30 | No. 11, 0.7 | — | 66.0 | 71.6 | 2400 | " | 9.3 |
| 16 | " | " | 25 | No. 13, 0.5 | — | 66.0 | 84.5 | 740 | " | 4.1 |
| 17 | " | " | 35 | No. 14, 0.5 | — | 68.5 | 75.0 | 1600 | " | 5.5 |
| 18 | " | B | 35 | No. 15, 0.5 | 53.0 | 71.0 | 81.5 | 1300 | " | 4.5 |
| 19 | " | " | 30 | No. 22, 0.5 | 59.0 | 71.0 | 83.0 | 1400 | " | 3.5 |
| 20 | " | C | 30 | No. 17, 0.5 | 55.0 | 71.0 | 79.0 | 1300 | " | 6.0 |
| 21 | " | " | 33 | No. 18, 0.5 | 59.0 | 71.0 | 82.5 | 1200 | " | 5.0 |
| 22 | anthracite | A | 30 | No. 12, 0.8 | — | 68.0 | 72.5 | 2300 | " | 8.7 |
| 23 | " | " | 23 | No. 14, 0.6 | — | 68.0 | 82.0 | 530 | " | 2.5 |
| 24 | " | " | 35 | No. 15, 0.6 | — | 72.5 | 76.7 | 1700 | " | 7.0 |
| 25 | " | B | 30 | No. 16, 0.6 | 53.0 | 75.0 | 82.3 | 1200 | " | 4.5 |
| 26 | " | " | 38 | No. 20, 0.6 | 58.0 | 78.0 | 78.0 | 1600 | " | 5.0 |
| 27 | " | C | 33 | No. 21, 0.6 | 55.0 | 75.0 | 81.0 | 1100 | " | 3.0 |
| 28 | " | " | 33 | No. 19, 0.6 | 58.0 | 78.0 | 79.2 | 1500 | " | 6.5 |
| 29 | bituminous | A | 25 | No. 25, 0.7 | — | 66.0 | 74.5 | 2100 | " | 9.0 |
| 30 | " | " | 32 | No. 30, 0.5 | — | 66.0 | 82.5 | 550 | " | 3.5 |
| 31 | " | " | 30 | No. 26, 0.5 | — | 68.5 | 71.0 | 2500 | " | 9.5 |
| 32 | " | B | 35 | No. 28, 0.5 | 52 | 71.0 | 83.0 | 1600 | " | 4.0 |
| 33 | " | " | 30 | No. 30, 0.5 | 55 | 71.0 | 82.3 | 1300 | " | 5.2 |
| 34 | " | " | 30 | No. 35, 0.5 | 55 | 71.0 | 80.5 | 1400 | " | 2.5 |
| 35 | " | C | 30 | No. 31, 0.5 | 58 | 71.0 | 82.0 | 1200 | " | 3.0 |
| 36 | " | " | 28 | No. 37, 0.5 | 55 | 71.0 | 84.0 | 1100 | " | 2.5 |
| 37 | anthracite | A | 33 | No. 26, 0.8 | — | 68.0 | 73.5 | 2000 | " | 8.0 |

TABLE II-continued

| Run No. | Coal | Method | % occupied by grinding media[1] | Polyether cpd., %[2] | Coal concentration, % 1st stage | Final stage | % passing through 200 mesh screen | Viscosity, cps | Fluidity | Stability, sec. |
|---|---|---|---|---|---|---|---|---|---|---|
| | Aqueous Coal Slurries | | | | | | | | | |
| | Operation Conditions | | | | | | Characteristics | | | |
| 38 | " | " | 33 | No. 33, 0.6 | — | 68.0 | 84.4 | 600 | " | 2.0 |
| 39 | " | " | 25 | No. 27, 0.6 | — | 72.5 | 70.6 | 2500 | " | 9.0 |
| 40 | " | B | 38 | No. 29, 0.6 | 53 | 75.0 | 84.0 | 1400 | " | 6.0 |
| 41 | " | " | 38 | No. 34, 0.6 | 58 | 75.0 | 83.5 | 1300 | " | 4.0 |
| 42 | " | " | 35 | No. 36, 0.6 | 55 | 78.0 | 79.0 | 1800 | " | 6.5 |
| 43 | " | C | 30 | No. 32, 0.6 | 55 | 75.0 | 83.0 | 1200 | " | 3.5 |
| 44 | " | " | 30 | No. 38, 0.6 | 58 | 78.0 | 79.5 | 1900 | " | 7.0 |
| | | | | | (Controls) | | | | | |
| 45 | bituminous | A | 30 | None | — | 66.0 | impossible | — | None | —[3] |
| 46 | " | " | 35 | No. 9, 1.0 | — | 60.0 | 48.0 | — | " | — |
| 47 | anthracite | " | 35 | No. 10, 1.0 | — | 62.0 | 52.0 | — | " | — |
| 48 | bituminous | " | 35 | No. 23, 1.0 | — | 60.0 | 45.0 | — | " | — |
| 49 | anthracite | " | 35 | No. 24, 1.0 | — | 62.0 | 43.3 | — | " | — |
| 50 | bituminous | " | 35 | No. 39, 1.0 | — | 60.0 | 45.0 | — | " | — |
| 51 | snthracite | " | 35 | No. 40, 1.0 | — | 62.0 | 43.0 | — | " | — |

Note:
[1]% interior volume of mill occupied by the apparent volume of grinding media.
[2]based on the weight of final slurry.
[3]Too viscous to measure.

Table II shows that aqueous coal slurries pulverized to 72.0–86.0% passing through a 200 mesh screen were prepared at coal concentrations of 66–78% by weight according to the method of the present invention, whereas control runs failed to reach the same pulverization degree even at coal concentrations of 60–66% by weight.

Also slurries prepared by the method of the present invention were flowable and stable on storage, while slurries of control runs lost fluidity in the course of the pulverization process and thus no further pulverization could be continued.

EXAMPLE 2

All runs of Example 1 were continued until slurries were gelled and no further pulverization became possible. The gelling time (the length of pulverization time until gelation) was measured in each run. The results are shown in Table III.

TABLE III

| Run No. | Coal | Method | % occupied by grinding media | Polyether cpd., % | Coal concentration 1st stage | Final stage | Gelling time, minute |
|---|---|---|---|---|---|---|---|
| | Aqueous Coal Slurries | | | | | | |
| | Operational Conditions | | | | | | |
| 1 | bituminous | A | 30 | No. 1, 0.7 | — | 66.0 | 80 |
| 2 | " | " | 23 | No. 5, 0.5 | — | 66.0 | 120 |
| 3 | " | " | 35 | No. 3, 0.5 | — | 68.5 | 115 |
| 4 | " | B | 35 | No. 5, 0.5 | 53 | 71.0 | 120 |
| 5 | " | " | 30 | No. 6, 0.5 | 59 | 71.0 | 140 |
| 6 | " | C | 30 | No. 7, 0.5 | 55 | 71.0 | 150 |
| 7 | " | " | 35 | No. 8, 0.5 | 59 | 71.0 | 150 |
| 8 | anthracite | A | 35 | No. 2, 0.8 | — | 68.0 | 85 |
| 9 | anthracite | " | 35 | No. 5, 0.6 | — | 68.0 | 115 |
| 10 | " | " | 25 | No. 4, 0.6 | — | 72.0 | 120 |
| 11 | " | B | 38 | No. 6, 0.6 | 52 | 75.0 | 140 |
| 12 | " | " | 38 | No. 7, 0.6 | 58 | 78.0 | 150 |
| 13 | " | C | 30 | No. 8, 0.6 | 52 | 75.0 | 145 |
| 14 | " | " | 30 | No. 7, 0.6 | 58 | 78.0 | 150 |
| 15 | bituminous | A | 30 | No. 11, 0.7 | — | 66.0 | 78 |
| 16 | " | " | 25 | No. 13, 0.5 | — | 66.0 | 115 |
| 17 | " | " | 35 | No. 14, 0.5 | — | 68.5 | 145 |
| 18 | " | B | 35 | No. 15, 0.5 | 53.0 | 71.0 | 125 |
| 19 | " | " | 30 | No. 22, 0.5 | 59.0 | 71.0 | 130 |
| 20 | " | C | 30 | No. 17, 0.5 | 55.0 | 71.0 | 150 |
| 21 | " | " | 33 | No. 18, 0.5 | 59.0 | 71.0 | 120 |
| 22 | anthracite | A | 30 | No. 12, 0.8 | — | 68.0 | 83 |
| 23 | " | " | 23 | No. 14, 0.6 | — | 68.0 | 150 |
| 24 | " | " | 35 | No. 15, 0.6 | — | 72.5 | 125 |
| 25 | " | B | 30 | No. 16, 0.6 | 53 | 75.0 | 130 |
| 26 | " | " | 38 | No. 20, 0.6 | 58 | 78.0 | 145 |
| 27 | " | C | 33 | No. 21, 0.6 | 55 | 75.0 | 120 |
| 28 | " | " | 33 | No. 19, 0.6 | 58 | 78.0 | 130 |
| 29 | bituminous | A | 25 | No. 25, 0.7 | — | 66.0 | 82 |
| 30 | " | " | 32 | No. 30, 0.5 | — | 66.0 | 120 |
| 31 | " | " | 30 | No. 26, 0.5 | — | 68.5 | 80 |
| 32 | " | B | 35 | No. 28, 0.5 | 52 | 71.0 | 120 |
| 33 | " | " | 30 | No. 30, 0.5 | 55 | 71.0 | 120 |
| 34 | " | " | 30 | No. 35, 0.5 | 55 | 71.0 | 130 |
| 35 | " | C | 30 | No. 31, 0.5 | 58 | 71.0 | 145 |
| 36 | " | " | 28 | No. 37, 0.5 | 55 | 71.0 | 140 |

TABLE III-continued

| Run No. | Coal | Method | % occupied by grinding media | Polyether cpd., % | Coal concentration 1st stage | Coal concentration Final stage | Gelling time, minute |
|---|---|---|---|---|---|---|---|
| | Aqueous Coal Slurries Operational Conditions | | | | | | |
| 37 | anthracite | A | 33 | No. 26, 0.8 | — | 68.0 | 80 |
| 38 | " | " | 33 | No. 33, 0.6 | — | 68.0 | 120 |
| 39 | " | " | 25 | No. 27, 0.6 | — | 72.5 | 83 |
| 40 | " | B | 38 | No. 29, 0.6 | 53 | 75.0 | 120 |
| 41 | " | " | 38 | No. 34, 0.6 | 58 | 75.0 | 135 |
| 42 | " | " | 35 | No. 36, 0.6 | 55 | 78.0 | 130 |
| 43 | " | C | 30 | No. 32, 0.6 | 55 | 75.0 | 150 |
| 44 | " | " | 30 | No. 38, 0.6 | 58 | 78.0 | 120 |
| | | | | (Controls) | | | |
| 45 | bituminous | A | 30 | None | — | 66.0 | 0 |
| 46 | " | " | 35 | No. 9, 1.0 | — | 60.0 | 20 |
| 47 | anthracite | " | 35 | No. 10, 1.0 | — | 62.0 | 15 |
| 48 | bituminous | " | 35 | No. 23, 1.0 | — | 60.0 | 20 |
| 49 | anthracite | " | 35 | No. 24, 1.0 | — | 62.0 | 15 |
| 50 | bituminous | " | 35 | No. 39, 1.0 | — | 60.0 | 20 |
| 51 | anthracite | " | 35 | No. 40, 1.0 | — | 62.0 | 15 |

Table III shows that polyether compounds used in the present invention were capable of prolonging the gelling time for at least 80 minutes, whereas slurries in control runs gelled very quickly.

The table also shows that polyether compounds having an oxyethylene content greater than 80% by weight based on the total oxyalkylene content were more effective for extending gelling time than those having an oxyethylene content less than 80%.

EXAMPLE 3

Some of the runs of Example 1 were repeated in the continuous mode. A 50 liter capacity wet ball mill filled 30% of its interior volume with grinding media was continuously charged with coal, water and polyether compounds in amounts corresponding to respective runs and slurries were discharged after a resident time for 70 minutes.

All runs according to the present invention gave flowable slurries pulverized to 70–85% passing through a 200 mesh screen, whereas control runs failed to give flowable slurries and instead produced gelation of slurries in the mill.

The above tests were repeated except that feeding rates of materials were decreased to 70% and the resident time was extended to 100 minutes. Polyether compounds having an oxyethylene content greater than 80% by weight based on the total oxyalkylene content exhibited satisfactory results.

We claim:

1. In a method for forming aqueous coal slurries which comprises pulverizing coarse coal particles in the presence of an amount of water sufficient to form said slurries having a coal concentration from 60 to 80% by weight until the coal particles are pulverized to at least 70% passing through a standard 200 mesh screen, the improvement wherein said wet pulverization of coal is carried out also in the presence of a polyether of a molecular weight from 16,000 to 300,000 and selected from the group consisting of a polyoxyalkylene adduct (a) with a polyhydroxyl compound having at least three hydrogen atoms; a polyoxyalkylene adduct (b) with a condensate, having a degree of condensation of at least 2, of a phenolic compound with an aliphatic aldehyde, a polyoxyalkylene adduct with a polyalkyleneimine or a derivative thereof containing 7 to 200 nitrogen atoms; and derivatives (c) of said adducts (a) or (b) which are esters, at the terminal hydroxyl groups of said adducts (b) or (c), with inorganic or organic acids, halides, aldehydes, carboxylic acids or urethanes with monoisocyanates.

2. The method according to claim 1, wherein said polyether compound is present such that the final slurries contain from 0.03 to 2.0% of said compound based on the total weight of said slurries.

3. The method according to claim 1, wherein said polyether compound has an oxyethylene content greater than 60% by weight based on the total oxyalkylene content.

4. The method according to claim 3, wherein said oxyethylene content is greater than 80% by weight.

5. The method according to claim 1, wherein said polyhydroxyl compound has at least five active hydrogen atoms.

6. The method according to claim 1, wherein said aliphatic aldehyde is formaldehyde.

7. The method according to claim 6, wherein said condensate has a condensation degree from 1.5 to 50.

8. The method according to claim 7, wherein said condensation degree is from 2.0 to 30.

9. The method according to claim 1, wherein said polyalkyleneimine or a derivative thereof contains from 9 to 100 nitrogen atoms.

10. The method according to claim 1, wherein said coal is bituminous or anthracite.

* * * * *